United States Patent [19]

Kroener et al.

[11] 4,362,933

[45] Dec. 7, 1982

[54] MULTISTAGE VACUUM X-RAY IMAGE INTENSIFIER

[75] Inventors: Ulrich Kroener, Forchheim; Walter Greschat, Dormitz; Peter Roemer, Erlangen, all of Fed. Rep. of Germany

[73] Assignee: Siemens Aktiengesellschaft, Berlin & Munich, Fed. Rep. of Germany

[21] Appl. No.: 227,472

[22] Filed: Jan. 22, 1981

[30] Foreign Application Priority Data

Feb. 6, 1980 [DE] Fed. Rep. of Germany ..... 3004351

[51] Int. Cl.[3] ..... H01J 31/50

[52] U.S. Cl. ..... 250/213 VT; 313/95

[58] Field of Search ..... 250/213 VT; 313/94, 313/95, 102, 101

[56] References Cited

U.S. PATENT DOCUMENTS

| | | | |
|---|---|---|---|
| 2,555,423 | 6/1951 | Sheldon | 313/101 |
| 3,497,699 | 2/1970 | Pietri et al. | 313/95 |
| 3,749,920 | 7/1973 | Sheldon | 250/213 VT |

*Primary Examiner*—David C. Nelms

*Attorney, Agent, or Firm*—Hill, Van Santen, Steadman, Chiara & Simpson

[57] ABSTRACT

In an examplary embodiment wherein the x-ray image, converted into an electron image, is intensified through acceleration in the electrical field, in at least two stages which are inter-coupled via an intermediate screen, such screen contains, as significant elements, a cathodoluminescent layer and a photocathode layer which is optically in contact with the latter. Of these, the one is disposed on the one side and the other is disposed on the opposite side of a satisfactorily stable carrier plate which allows the light of the cathodoluminescent layer to pass through. In the case of this intermediate screen it is difficult to keep the surface sufficiently clean for the purpose of applying the photocathode layer. To this end, the disclosure provides that the surface of the carrier plate be coated with a coating which is resistant to the photocathode layer, which coating, for a photocathode layer of cesium antimony, can be comprised of cesium iodide and be 5 and 10 μm thick. Thus a tight (or sealed) covering of the base and a clean surface are obtained. An x-ray image intensifier improved in accordance with the disclosure is particularly suited for use in medical x-ray diagnostics.

6 Claims, 1 Drawing Figure

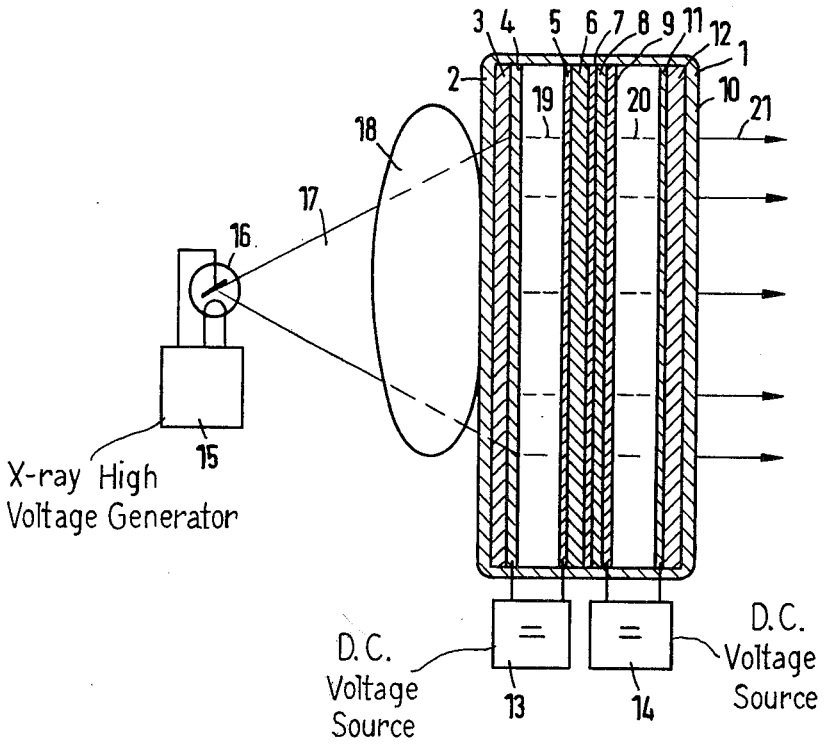
3
4
5
6
7
8
9
11
12
1
2
10
21
19
20
18
17
16
15
X-ray High
Voltage Generator
D.C.
Voltage
Source
13
14
D.C.
Voltage
Source

MULTISTAGE VACUUM X-RAY IMAGE INTENSIFIER

BACKGROUND OF THE INVENTION

The invention relates to multistage x-ray image intensifiers according to the preamble of claim 1. Image intensifiers of this type are, for example, known from the U.S. Pat. No. 2,555,423.

In the case of multistage image intensifiers, in which the x-ray image is first converted into an electron image, the individual stages intensifying the electron image through acceleration in the electrical field, respectively, are coupled with one another via screens which exhibit, as significant elements, a fluorescent or cathodoluminescent layer and a photocathode layer which is optically in contact therewith. However, these two reactive layers per se usually have only little stability (or strength). Therefore, they are applied on opposite sides of a sufficiently stable carrier plate which allows the light released in the fluorescent layer to pass through to the photocathode layer applied on the other side.

The carrier must be so constructed that a good "contact copy" of the fluorescent screen image results on the photocathode; i.e., that the carrier effects no reduction in the definition (or sharpness) of the image. This is attainable e.g. through the utilixation of fiber optics plates as carriers for the layers. However, they have the major disadvantage that they are very expensive.

A reduction in costs could be achieved through the utilization of transparent plates or foils; for example consisting of glass, mica, or a vacuum-stable organic material (e.g. polyimide), or the like. However, the thickness of the carrier layer cannot be permitted to effect any substantial scattering of the traversing light. For the definitions, utilizable as a rule in these devices, a thickness of the carrier layer e.g. up to fifty microns (50 μm) would still be permissible. In the case of known methods, first the fluorescent layer is applied on the carrier. These subsequently follows the incorporation of the carrier and fluoroscent layer in the image intensifier arrangement and finally the application of the photocathode layer on the still free surface of the carrier which lies opposite the fluorescent layer.

Most the intermediate screens, manufactured in a known fashion, exhibit non-uniform brightness transmission over the surface. This can be explained, for example, in that even in the case of originally satisfactorily clean carrier surfaces, with the deposition of the fluorescent material on the one side of the carrier, the opposite side, to be coated later with the photocathode, becomes "contaminated" by the means employed during the manufacture of the fluorescent screen (because, on account of the sensitivity of the thin foil, no satisfactory protection is possible). The low stability of the foil is also the reason that the "contaminated" surface cannot subsequently be satisfactorily cleansed. Thus the local defects (or disturbances) of the photocathode, and hence a patchy (or spotty) image is obtained.

SUMMARY OF THE INVENTION

The object underlying the invention resides in disclosing, in the case of image intensifiers according to the preamble of claim 1, a coupling or intermediate screen which yields satisfactory images and which is nevertheless economical as well as simple to manufacture. In accordance with the invention, this object is achieved by the measures disclosed in the characterizing clause of claim 1. The subject of the subclaims relate to advantageous further developments of the invention.

The invention proceeds from the assumption that a clean base for the photocathode can also be obtained in that, prior to application of the photocathode, a clean coating is applied. Moreover, it has proven expedient to provide areas on the inlet screen as well as on the intermediate screen which are similar and which simultaneously form a barrier against influences from the base. However, attention must be paid to the fact that the application on the area of the coupling screen is to be thin in order to keep the loss of light and sharpness minimal; i.e., in order that the light passing from the fluorescent screen into the photocathode is not unduly absorbed and scattered.

Through the additional layer the following advantages result;

(a) There is provided a cathode-compatible diffusion barrier against contaminations from the carrier surface, which otherwise can lead to the partial "poisoning" of the photocathode.

(b) On the inlet screen as well as on the carrier of the intermediate screen (or screens), the same substrate is obtained for the photocathode, so that more uniform cathodes can be obtained.

(c) In the case of defective manufacture of the photocathode and utilization of an additional layer comprised of a means which is soluble in a liquid which does not attack (or corrode) the carrier, the photocathode layer, together with the additional layer, can be washed off, and the screen can be utilized again.

In the case of the currently conventional x-ray image intensifiers, in which cesium iodide doped with sodium (CsI:Na) is employed as the x-ray sensitive material of the inlet screen, a vacuum vapor deposition of the intermediate screen with CsI:Na has proven favorable. The thickness of the coating of CsI:Na on the surface or surfaces, which are later to be coated with the photocathode layer, should be at least so great that a tight (or sealed) covering on the base is obtained. When this is achieved, the vapor-deposition with cesium iodide can be discontinued. An upper limit is provided by the still acceptable image unsharpness or (blurring).

A method which has proven favorable is one wherein the "contaminated" surface is coated, prior to the coating with the photocathode, with a layer consisting of CsI:Na which is five to ten microns (5 to 10 μm) thick. Thus a very clean base for the photocathode is obtained. Moreover, the inlet screen as well as the intermediate screen, or screens, respectively, receive surfaces of the same material; i.e. the same substrate results. This brings about the possibility of manufacturing the photocathode in the same, or in a similar, operating sequence (or cycle). Thus cathodes of the same cesium saturation can be obtained. In the case of earlier methods, an oversaturation of a cathode could come about on account of different formation speeds occurring on different bases. In the case of the invention, an antimony (Sb)-source is sufficient, whereas, in the case of the known manufacture, on account of the necessary matching (or adaptation) to the substrate, a specific Sb-source was required. In the case of utilization of water-soluble cesium iodide as material of the additional layer, the cathode material together with the cesium iodide undercoating can simply be rinsed off with water.

The invention technique can also be advantageously employed in those instances in which a subsequent cleansing of the cathode area would be possible per se. Through the inventive intermediate layer, as a rule, in addition to the above-disclosed advantages, a substantial simplification can be achieved because the cleansing step can be dispensed with (cleansing, polishing, etc.).

Details and advantages of the invention shall be explained in greater detail in the following on the basis of an exemplary embodiment in the form of a flat image intensifier tube, illustrated in the Figure on the accompanying drawing.

BRIEF DESCRIPTION OF THE DRAWINGS

The single FIGURE is a somewhat diagrammatic view of an x-ray diagnostic system wherein an embodiment of the inventive x-ray image intensifier is shown in longitudinal section.

DETAILED DESCRIPTION

In the FIGURE, a vacuum-tight (or sealed) envelope is designated with 1, which bears, at its one end wall 2, in the interior of the envelope, a luminescent layer 3, which is followed by a photocathode layer 4. At an interval of approximately 12 mm, an electron-sensitive luminescent screen follows which is comprised of an electron-transmissive (or transparent), light-reflecting covering 5 of aluminum and of a cathodoluminescent layer 6. The latter rests on a carrier (or support) 7 of mica which is fifty microns (50 μm) thick. On its free surface, the carrier 7 is provided with a coating 8 of cesium iodide which is eight microns (8 μm) thick. Finally, on the layer 8, a photocathode layer 9, corresponding to the layer 4, is applied. The fluorescent screen combination, disposed at the outlet side 10 opposite the inlet side 2, consists, like that designated by 5 and 6 in the intermediate screen, of a covering 11 of aluminum and a cathodoluminescent layer 12.

For operation of the image intensifier, for the purpose of close-up focusing and acceleration, a voltage of 15 kV from a d. c. voltage source 13 is applied between the photocathode 4 and the aluminum layer 5. For the same purpose, a voltage of 20 kV from a d. c. source 14 is applied between the photocathode 9 and the aluminum covering 11.

In order to generate an x-ray image, an installation including a high voltage generator 15 and an x-ray tube 16 for generating x-rays provides a radiation beam 17, coming from the x-ray tube 16 and directed at a body 18. Following penetration of the body 18, the rays from the beam 17 pass through the inlet window 2 onto the luminescent screen 3, generate light there which acts on the photocathode 4 and releases electrons there. Corresponding to the indication by broken lines 19, the electrons are then accelerated in the direction of the luminescent screen consisting of layers 5 and 6. The electrons there release light with the object of achieving the desired image formation and intensification with respect to the original electron image at 19, which light acts through the carrier 7 and the coating 8 on the photocathode 9 and there again releases an electron beam 20, which then releases light in the fluorescent screen consisting of layers 11 and 12, which light, as indicated by arrows 21, can be observed from the exterior.

It will be apparent that many modifications and variations may be effected without departing from the scope of the novel concepts and teachings of the present invention.

We claim as out invention:

1. A multistage x-ray image intensifier, comprising an inlet screen responsive to an x-ray image and producing an electron image which is intensified in an electrical acceleration field, and an outlet screen for supplying a corresponding visible image, an intermediate screen disposed between the end of the acceleration field and the outlet screen with at least one additional electric acceleration field commencing with the intermediate screen, and the intermediate screen comprising a light-transmissive carrier, a cathodoluminescent layer on the side of the carrier facing the inlet screen, and a photocathode layer on the opposite side of said carrier, said intermediate screen further comprising a coating (8) applied to said opposite side of the carrier (7), said coating (8) being resistant with respect to contamination of the photocathode layer (9) and having the photocathode layer (9) thereon.

2. An image intensifier according to claim 1, with the inlet screen having a luminescent coating (3) thereon of the same material as said coating (8) of said intermediate screen.

3. An image intensifier according to claim 1, with said coating (8) being a vapor-deposition layer which tightly covers the carrier (7).

4. An image intensifier according to claim 1, with the coating (8) being comprised of cesium iodide (CsI).

5. An image intensifier according to claim 3, with the coating (3) being comprised of cesium iodide luminescent material activated with sodium (CsI:Na).

6. An image intensifier according to claim 5, with the coating (8) of the intermediate screen having a thickness of five to ten microns.

* * * * *